United States Patent [19]

Garcia

[11] 4,445,287

[45] May 1, 1984

[54] SKATE BOOT COVER

[76] Inventor: Mario C. Garcia, 1167 Ottawa Ave., West St. Paul, Minn. 55118

[21] Appl. No.: 395,489

[22] Filed: Jul. 6, 1982

[51] Int. Cl.[3] ..... A43B 3/18; A43B 5/00

[52] U.S. Cl. ..... 36/106; 36/7.2; 36/114

[58] Field of Search ..... 36/7.1, 106, 110, 114, 36/7.2, 1.5, 2 R

[56] References Cited

U.S. PATENT DOCUMENTS

| | | | |
|---|---|---|---|
| 253,402 | 2/1882 | Martin . | |
| 3,012,343 | 12/1961 | Dinkel . | |
| 3,027,660 | 4/1962 | Werner | 36/7.1 R |
| 3,087,260 | 4/1963 | Hudson | 36/7.2 |
| 3,820,254 | 6/1974 | Kopacsi . | |
| 4,168,584 | 9/1979 | Wren et al. | 36/114 |
| 4,361,912 | 12/1982 | Arthur | 36/114 |

*Primary Examiner*—Patrick D. Lawson

*Attorney, Agent, or Firm*—Orrin M. Haugen; Thomas J. Nikolai; Douglas L. Tschida

[57] ABSTRACT

A releasably attachable insulative covering for a skate shoe and comprising a covering panel adapted to envelop the skate shoe and fabricate it from thermally insulative material. The panel includes a toe covering portion, a heel covering portion, and an in-step covering portion therebetween, with flexible fastening means for releasably attaching the covering panel to the skate shoe. The flexible fastening means includes a plurality of mating interconnecting pairs of hooks and loops, and are mounted on the covering panel with one such mating pair being secured generally vertically along the rear portion of the panel to form a heel closure, and with another such mating pair being secured as cross-strap tab fasteners for coupling generally transversely across the undersurface of the arch portion of the skate shoe.

2 Claims, 5 Drawing Figures

SKATE BOOT COVER

BACKGROUND OF THE INVENTION

The present invention relates generally to a releasably attachable insulative covering for a skate shoe; and more particularly, to such an insulative covering which may be readily and easily secured about the skate shoe and without requiring unusual fastening operations for securing the item to the skate shoe. The insulative coverings are particularly adapted for use by skaters enjoying the sport in the out-of-doors and particularly during times of unusual or extreme cold.

Skating is a sport enjoyed by participants in the out-of-doors, and occasionally is undertaken by participants in unusually cold conditions. Since skating is seasonal, those participating in the sport must necessarily utilize outdoor rinks during periods of unusual or extreme cold, particularly when engaging in a scheduled activity. Clothing manufacturers have developed and offer commercially articles of clothing which protect the wearer and permit participation in outdoor sports including skating under almost any temperature condition. For skaters, however, the skate shoe is typically fabricated from leather with conventional laces being used to securely fasten the skate shoe to the wearer's foot and ankle. The sport of skating requires that the skate shoe be firmly fastened, without any significant or substantial relative motion existing between the foot and ankle of the wearer, and the skate shoe. Such requirements reduce the opportunity for the wearer to employ thermally insulative socks or underclothing; and hence, while all other portions of the skater may be appropriately protected from the cold, the feet may become cold for some skaters.

In accordance with the present invention, releasably attachable insulative covering elements for skate shoes are provided, with these insulative coverings being readily detachable from the skate, and further providing a significant degree of protection from the cold. These insulative coverings provide their warmth without adversely affecting the ability of the skater to enjoy the sport, and without providing any detectable or noticeable change from the condition of the skate shoe without the insulative covering attached. Furthermore, the releasably attachable insulative covering of the present invention are soft, pliable, and easily carried by the skater, either temporarily about the skate shoe, or folded in with other articles of wearing apparel for the skater. The releasably attachable skate shoe covering may be placed about the skate shoe without requiring unusual agility, and may be accomplished even while the skater is wearing the skate shoe.

Therefore, it is a primary object of the present invention to provide an improved releasably attachable insulative covering for a skate shoe, and specifically providing such an insulative covering which may be worn by the skater without adversely or noticeably changing the condition of the skate shoe.

It is a further object of the present invention to provide an improved releasably attachable insulative covering for a skate shoe which includes flexible fastening means for conveniently securing the insulative covering about the skate shoe, and with the flexible fastening means performing the fastening function without significantly increasing the weight of the skate shoe, and thereby avoiding adversely effecting the characteristic, feel, and performance of the skate shoe for the skater.

Other and further objects of the present invention will become apparent to those skilled in the art upon a study of the following specification, appended claims, and drawing.

IN THE DRAWING

Figure 1:
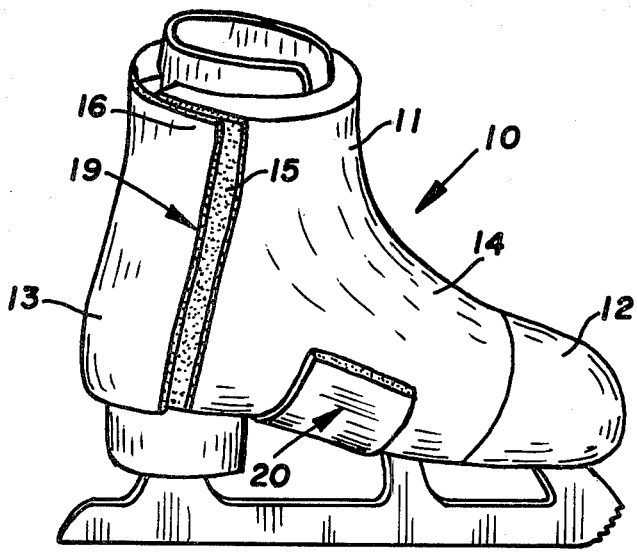
FIG. 1 is a prospective view of a skate, including the skate shoe and blade, with the releasably attachable insulative covering secured about the skate shoe.
Figure 2:
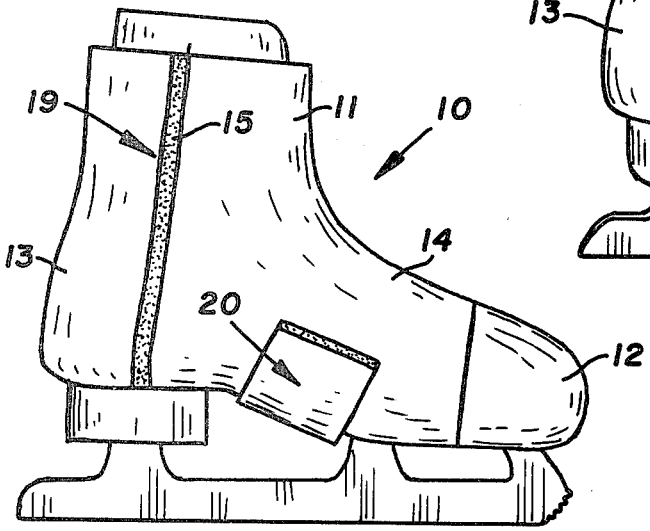
FIG. 2 is a side elevational view of a skate shoe, with blade attached, and with the releasably attachable insulative covering secured thereto.
Figure 4:
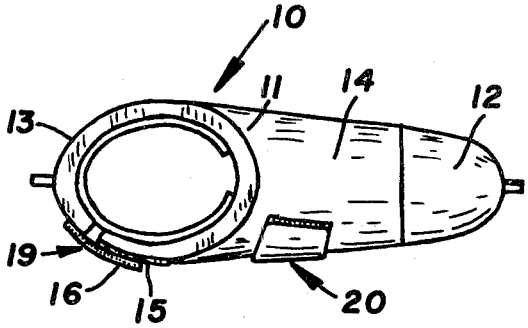
FIG. 4 is a top plan view of a skate shoe with the insulative covering secured thereto, and showing the manner in which the heel covering portion envelopes the heel of the skate shoe.

In accordance with the preferred modification of the present invention, and with particular attention being directed to FIGS. 1 and 2 of the drawing, the releasably attached insulative covering generally designated 10 includes a covering panel means 11 adapted to envelop a wearer's skate shoe. The insulative covering panel is fabricated from thermally insulative material, and preferably from such a material having a durable outer covering. The outer covering should be durable mechanically, and retain these characteristics when subjected to cold temperatures. Such insulative covering materials are commercially available.

Figure 3:
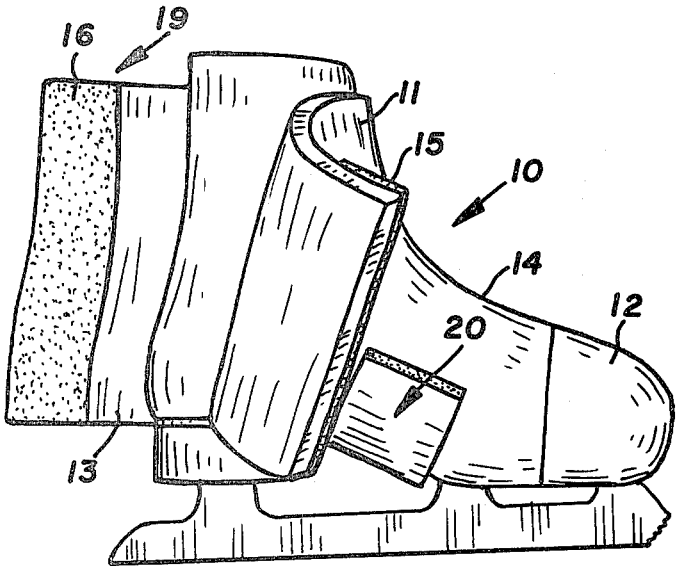
FIG. 3 is a view similar to FIG. 2, but with the insulative covering portion being only partially secured to the skate shoe, and with the heel portion being unfastened.

The covering panel means 11 includes a toe closure portion 12, a heel covering portion 13, along with an in-step covering portion as at 14. The in-step covering portion 14 is formed in part from right and left lateral covering portions 15 and 16, which are more specifically and particularly illustrated in FIG. 3 of the drawing. Flexible fastening means are provided for releasably attaching the covering panel to the skate shoe, with such flexible fastening means being shown generally at 19 and 20, particularly as illustrated in FIGS. 2 and 3.

The flexible fastening means include a plurality of mating interconnecting pairs of hooks and loops, and are fabricated from flexible materials. The substrate of the fastening means is mounted on the covering panel means by conventional means such as sewing or the like. The flexible fastening means 19 is adapted to form a closure for the heel covering portion of the insulative covering, while the fastening means 20 is secured to the insulative covering panel 11 as cross-strap tab fastening members for forming a transverse connection across and beneath the arch of the skate shoe. The fastening means 20 is located generally medially of the covering member, and along the right and left lateral covering panel to form a transverse coupling beneath the arch portion of the skate shoe.

Figure 5:
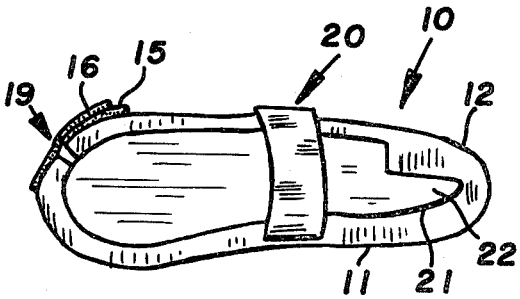
FIG. 5 is a bottom plan view of a skate shoe, with blade removed, and illustrating the manner in which the insulative covering is secured about the skate shoe.

Attention is now directed to FIG. 5 of the drawing wherein the underside of the covering is illustrated, and particularly the underside of the toe covering portion 12. It will be observed that a slotted zone is formed as at 21, to provide an opening 22 to accommodate or adjust various skate shoe widths. This slotted portion provides the further advantage of accommodating the blade without adversely effecting the insulative qualities of the covering.

In use and operation, the skater, after putting on his skates, merely places the toe portion 12 of the insulative covering member 10 about the toe of the skate shoe, and thereafter brings the lateral portions 15 and 16 about the lateral side portions of the skate shoe, and joints the members by the flexible fastening means or portions 15 and 16. Thereafter, the strap on the underside of the insulative covering is secured to complete the transverse fastening. The transverse fastening is positioned so as to pass directly under the arch portion, without being in contact with the support portions of the blade, which are used to couple the blade to the shoe.

During lengthy periods of unusual or extreme cold, the skater may merely leave the insulative covering members releasably attached to the skate shoe, with only the heel covering portions being required for release in order to gain access to the laces of the skate shoe. It is clear, therefore, that the insulative covering elements of the present invention permit the skater to enjoy the skate in the out-of-doors during periods when the sport may well otherwise be uncomfortable.

I claim:

1. A releasably attachable insulative covering for a skat shoe and comprising:

(a) covering means adapted to envelop the skate shoe and fabricated from thermally insulative material and including a toe covering portion, a heel covering portion, and an in-step covering portion, including right and left lateral covering panels, and flexible fastening means for releasably attaching the covering panel to the skate shoe;

(b) said heel covering portion being formed of adjoining extension panels from said right and left lateral covering portions; and (c) said flexible fastening means including a plurality of individual mating pairs of fasteners, each pair including a hook fastener portion and a loop fastener portion, with each of said fastener portions being mounted on said covering panel means, and with one of each such mating pairs of fasteners being secured generally vertically along each of said lateral covering portions to form a heel closure, and with one such mating pair being secured generally medially along said right and left lateral covering portions to form a cross-strap tab fastener extending generally transversely across and beneath the underside of the arc portion of the skate shoe.

2. The releasably attachable insulative covering as defined in claim 1, being particularly characterized in that said toe covering portion comprises a closure having a slotted portion formed therein along that part of the toe covering portion which underlies the skate shoe.

* * * * *

UNITED STATES PATENT AND TRADEMARK OFFICE

CERTIFICATE OF CORRECTION

PATENT NO. : 4,445,287

DATED : May 1, 1984

INVENTOR(S) : Mario C. Garcia

It is certified that error appears in the above-identified patent and that said Letters Patent are hereby corrected as shown below:

Column 4, Line 21, "arc" should read -- arch --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*